US007718985B1

(12) United States Patent
Bernath et al.

(10) Patent No.: US 7,718,985 B1
(45) Date of Patent: May 18, 2010

(54) ADVANCED DROPLET AND PLASMA TARGETING SYSTEM

(75) Inventors: Robert Bernath, Orlando, FL (US); Christopher Brown, Orlando, FL (US); Joshua Duncan, Orlando, FL (US); Kazutoshi Takenoshita, Oviedo, FL (US); Martin Richardson, Genova, FL (US); Jose A. Cunado, Altamonte Springs, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 843 days.

(21) Appl. No.: 11/586,975

(22) Filed: Oct. 26, 2006

Related U.S. Application Data

(60) Provisional application No. 60/732,232, filed on Nov. 1, 2005.

(51) Int. Cl.
*H01J 35/08* (2006.01)

(52) U.S. Cl. ..... 250/573; 250/504 R; 250/492.2; 250/493.1; 378/119

(58) Field of Classification Search ..... 250/573, 250/504 R, 492.2, 493.1; 378/119
See application file for complete search history.

(56) References Cited

U.S. PATENT DOCUMENTS

| | | | | |
|---|---|---|---|---|
| 6,002,744 | A | 12/1999 | Hertz et al. | 378/119 |
| 6,324,256 | B1 | 11/2001 | McGregor et al. | 378/119 |
| 6,792,076 | B2 | 9/2004 | Petach et al. | 378/119 |
| 6,855,943 | B2 | 2/2005 | Shields | 250/504 |
| 6,862,339 | B2 | 3/2005 | Richardson | 378/119 |
| 7,122,816 | B2 * | 10/2006 | Algots et al. | 250/504 R |

OTHER PUBLICATIONS

M. Richardson, C.-S. Koay, K. Takenoshita, C. Keyser, "High conversion efficiency mass-limited Sn-based laser plasma source for extreme ultraviolet lithography," J. Vac. Sci. Technol. B 22(2), Mar./Apr. 2004, pp. 785-790.

J.Q. Lin, H. Yashiro, T. Aota, T. Tomie, "EUV generation using water droplet target," Proceedings of SPIE, vol. 5374, Emerging Lithographic Technologies VIII, May 2004, pp. 906-911.

C-S Koay, K. Takenoshita, E. Fujiwara, M. Al-Rabban, M. Richardson, "Spectroscopic studies of the Sn-based droplet laser plasma EUV source," Proceedings of SPIE, vol. 5374, Emerging Lithographic Technologies VIII, May 2004, pp. 964-970.

O. Hemberg, B. A. M. Hansson, M. Berglund, H. M. Hertz, "Stability of droplet-target laser-plasma soft x-ray sources," Journal of Applied Phyics, vol. 88, No. 9, Nov. 1, 2000, pp. 5421-5425.

* cited by examiner

*Primary Examiner*—Seung C Sohn
(74) *Attorney, Agent, or Firm*—Brian S. Steinberger; Phyllis K. Wood; Law Offices of Brian S. Steinberger, P.A.

(57) ABSTRACT

Methods, systems, apparatus, devices for tracking, controlling and providing feedback on droplets used in EUV source technology. The method and system track and correct positions of droplet targets and generated plasma including generating the droplet target or plasma, optically imaging the generated target, determining position coordinates, comparing the position coordinates to a set optimal position to determine if a deviation has occurred and moving the generated target back to the optimal position if the deviation has occurred. The optical imaging step includes activating a light source to image the generated target, the light source is strobed at approximately the same rate as the droplet production to provide illumination of the droplet for stroboscopic imaging. The step of moving is accomplished mechanically by moving the generated target back to the predefined position or electronically under computer control.

24 Claims, 3 Drawing Sheets

Fig. 3
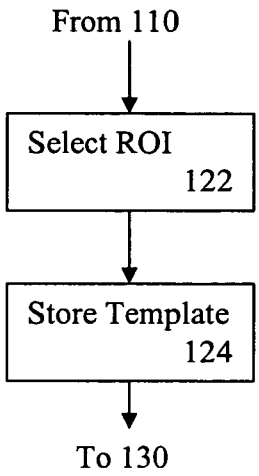
Fig. 5
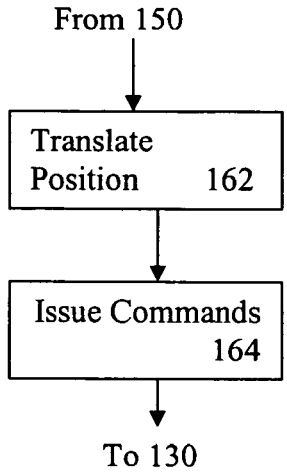
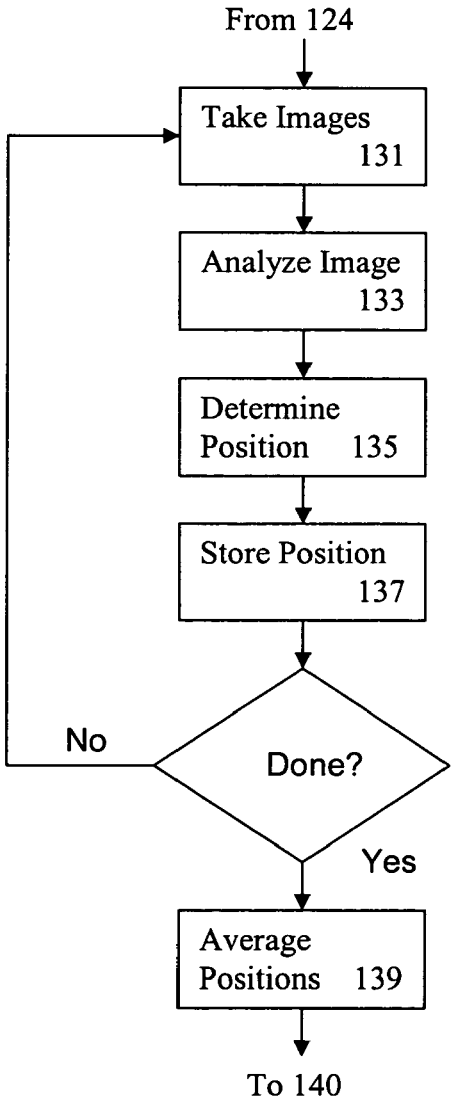
Fig. 4

ADVANCED DROPLET AND PLASMA TARGETING SYSTEM

This application claims the benefit of priority to U.S. Provisional Patent Application No. 60/732,232 filed on Nov. 1, 2005.

FIELD OF THE INVENTION

This invention relates to the generation of electromagnetic emission, in particular to methods, systems, apparatus and devices for tracking, providing feedback and controlling droplets used to create plasma.

BACKGROUND AND PRIOR ART

EUV lithography (EUVL) is the one of the candidates for Next Generation Lithography (NGL) for microchip fabrication. EUVL is designed for printing those microchips whose minimum feature size is 30 nm or even smaller. To achieve such a small feature size, EUVL utilizes a shorter wavelength of radiation. Like other lithographic systems, EUVL consists of a light source, mask, demagnifying optics, and photoresist on the wafer. To utilize such short wavelengths of radiation in the optical system, no lenses can be used, since most materials absorb these wavelengths. Mirrors must be used throughout. The mirrors for this application are very specialized, consisting of two different materials stacked together in very thin bilayers, known as Multi-layer mirrors (MLMs) or Bragg reflectors. EUVL mirrors are silicon-molybdenum MLMs whose reflectivity peaks at about 13.5 nm. The surface quality and uniformity of these optics must be extremely good due to the short wavelength.

EUVL also requires sufficient light source power and lifetime to reach the required throughput for production. The power requirement, which is determined by the lithographic industry, is being specified in terms of EUV power at the intermediate focus (IF) of the optical system, which is the border between the light source segment and scanning (also called "stepper") segment in the lithographic system. The specified EUV power is 115 W, within 2% bandwidth of 13.5 nm. Also, the lifetime of the light source is required to be 30,000 hours as described in Presented at International Sematech Source workshop, February 2004, Santa Clara, Calif. [1].

The radiation for EUVL is usually generated from a high-temperature plasma. There are two methods of plasma production currently being investigated in this research field: laser plasma (LP) and gas discharge plasma (GDP). Both techniques are capable of creating such high-temperature plasmas. An LP light source consists of a high-power laser, target delivery system, and a vacuum chamber in which the plasma is created. Similarly, GDP consists of a high-power current source, electrodes, and a vacuum chamber. One advantage of LP over GDP is that the material surrounding the plasma is further away in an LP system, which allows a higher repetition rate of the plasma generation in order to reach the EUV light source power requirement. There is also an advantage of LP in terms of collecting useful radiation from the plasma. Due to the extensive electrode structure necessary for GDP, only a part of the radiation can be collected. In other words, the collection solid angle is limited by the electrodes.

LP is produced by a material which is under strong laser irradiation, usually with intensities of more than $10^{10}$ W/cm$^2$. A single focusing lens with focal length of a few centimeters can be used for obtaining such a high-intensity laser focus. At these intensities, all of the material within the focus region of the laser beam will be ionized and become a high-temperature plasma. With a suitable material like tin, xenon, or lithium inside the target material, the plasma produces EUV emissions at 13.5 nm.

Many approaches are being investigated for EUVL light sources, such as xenon cluster jet which is described in U.S. Pat. No. 6,324,256; xenon filament described in U.S. Pat. No. 6,002,744), tin solid planar target, and others. Droplet target technology is one of the most promising for EUV lithography light sources. The advantage of this target over solid targets or other geometries is the reduced but sufficient mass of the target for EUV radiation. It is then possible to eliminate excess material from the plasma, which would tend to damage the MLM surfaces surrounding the plasma source. This scheme is necessary to achieve the EUVL light source lifetime requirement which is determined by the reflectivity lifetime of the mirror. The mirror reflectivity drops when the number of layers is decreased by ablation of the mirror surface, caused by target material emitted from the plasma. There are several approaches to generate appropriate droplet targets: water-based solution with tin doping as described in M. Richardson, et al. Journal of Vacuum Science and Technology B, volume 22, number 2, pp 785, (2004) and U.S. Pat. No. 6,862,339, liquid xenon described in U.S. Pat. No. 6,855,943, and liquid lithium described in Presented by Cymer Corp. at 3rd EUVL symposium, November 2004, Miyazaki, Japan.

The targets have to be positioned correctly within the laser focus region to produce a suitable-temperature plasma for EUV radiation. The size of the target ranges from a few tens of microns to possibly a few hundreds of microns where the laser focus region is adjusted to about the same size as the target. The target droplets are generated at high repetition rates, from a few kilohertz to a few tens of kilohertz, and travel at a few tens of meters per second. The laser pulse, with duration of a few nanoseconds to a few tens of nanoseconds, is focused. Any slight displacement of the target within the laser focal region during the laser pulse duration can cause reduced EUV emission. Thus high-precision controls over target positioning are required, both spatially within the laser focal region and temporally within the laser pulse duration.

An open-loop system is a simple approach for controlling the target positioning and laser pulse timing; i.e., a simple synchronization of the electrical signals controlling the droplet targets and laser pulse can be used. However, the generation of the droplet targets depends on many physical parameters of the target material and the orifice of the target supply. For instance, when the temperature of the target material changes, the viscosity of the material changes which leads to a slight change in the velocity of the droplet. Then the synchronization of the target and laser pulse has to be adjusted again. Similarly the physical profile of the orifice changes when the target material is deposited on the orifice over time. This changes the trajectory and stability of the targets. Again the target positioning has to be adjusted. These changes usually occur slowly, especially in long-term operation. In addition, EUVL requires full-time operation to meet the industry's fabrication throughput requirements. Therefore a closed-loop system is necessary to keep the target positioned correctly for best operation.

Several approaches have been published for controlling target positioning and synchronizing the target and the laser pulse. One approach is to generate the target dispensing signal from generated target signals as described in O. Hemberg, B. A. M. Hansson, M. Berglund, and H. M. Hertz, Journal of Applied Physics, Vol. 88, pp. 5421-5424 (2000) and in J-Q. Lin, et al.

Proceedings of the SPIE, Volume 5374, pp. 906-911 (2004). However, both approaches are only efficient in one dimension. When droplet trajectory changes by a certain amount the probe laser light no longer produces shadows, making it impossible to trigger the laser pulse. Another approach is to steer the droplet spatially as described in U.S. Pat. No. 6,792,076. With a steering actuator, any trajectory change can be compensated, limited by the size and velocity of the actuator. However, the temporal adjustment has to be done separately when the velocity of the droplets changes.

SUMMARY OF THE INVENTION

A primary objective of the present invention is to provide methods, systems, apparatus and devices for tracking, providing feedback and controlling droplets used in EUV source technology in three dimensions.

A secondary objective is to provide methods, systems, apparatus and devices for tracking, providing feedback and controlling droplets in three dimensions that can be used to stabilize any droplet target system used to generate electromagnetic emission.

A third objective of the present invention is to provide methods, systems, apparatus and devices for tracking, providing feedback and controlling droplets used in EUV source technology to provide compensation for various uncertainties of the physical parameters of the target within the system loop A fourth objective of the present invention is to provide methods, systems, apparatus and devices for tracking, providing feedback and controlling droplets used in EUV source technology in order to compensate both spatial displacement based on any trajectory change and temporal displacement based on droplet velocity changes.

A fifth objective of the present invention is to provide methods, systems, apparatus and devices that combines optical illumination and imaging, cutting-edge droplet technology, dedicated electronics, and custom software to provide active feedback stabilization of the droplet.

A first embodiment provides a method for tracking and correcting positions of generated plasma and droplet targets. The steps include generating the droplet target and plasma, optically imaging the generated target, determining position coordinates of the generated target from the optical image, comparing the determined position coordinates to a set position of the generated target to determine if a deviation has occurred and moving the generated target back to the set position if the deviation has occurred. The optical imaging step includes activating a light source to image the generated target, wherein the light source is strobed at approximately the same rate as the droplet production to provide illumination of the droplet for stroboscopic imaging. The step of moving may be accomplished by mechanically moving the generated target back to the set position or electronically under computer control.

A second embodiment provides an active feedback system for monitoring generated droplet and plasma targets. The system includes a controller with memory for executing instructions to electrically control operation of the system, a light source for optically illuminating the generated target, at least two cameras for imaging the illuminated target, and determining coordinate position of the generated target from the images, comparing the determined coordinate position to a predetermined position, and correcting the generated target position if it is outside the predetermined position. Determining the position coordinates includes analyzing the images from the at least two cameras for a predetermined number of cycles, storing the position coordinates and processing the stored position coordinates to reduce the effects of sudden motion. For example, processing may be averaging the stored position coordinates.

Further objects and advantages of this invention will be apparent from the following detailed description of the presently preferred embodiments which are illustrated schematically in the accompanying drawings.

BRIEF DESCRIPTION OF THE FIGURES

FIG. 3 is a flow diagram of the template step shown in FIG. 2.

FIG. 4 is a flow diagram of the steps corresponding to the acquisition step shown in FIG. 2.

FIG. 5 is a flow diagram of the steps corresponding to the move target step in FIG. 2.

DESCRIPTION OF THE PREFERRED EMBODIMENTS

Figure 1:
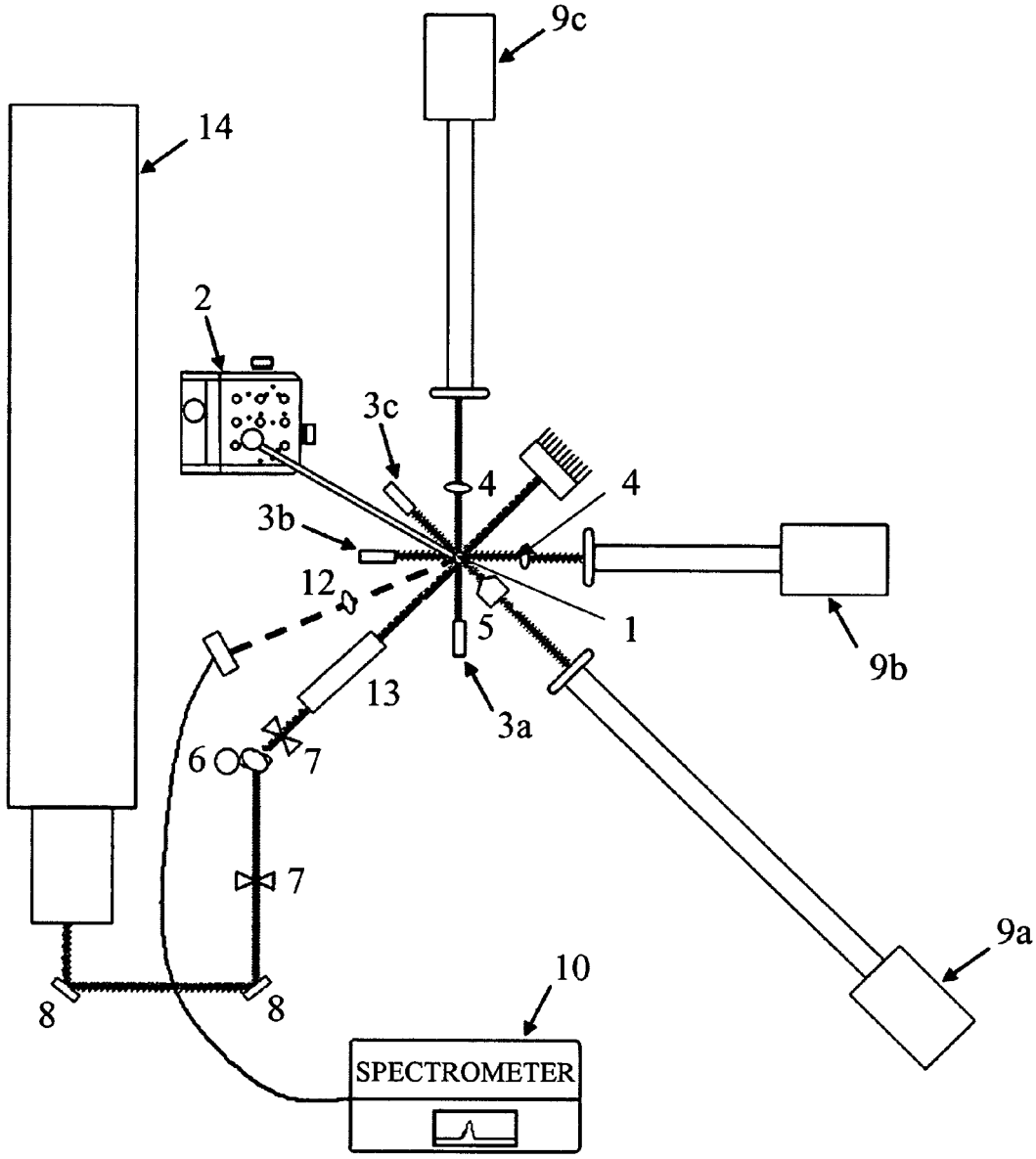
FIG. 1 shows a system overview of the main components of the invention.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

The following is a list of the reference numbers used in the drawings and the specification to identify components:

1 droplet capillary
2 motorized stages
3*a-c* light sources
4 imaging lens
5 imaging microscope objective
6 beam steering assembly
7 iris diaphragm
8 tuning mirror
9*a-c* imaging camera
10 spectrometer
12 light collection optics
13 focusing optics
14 laser The Advanced Droplet and Plasma Targeting System (ADaPTS) of the present invention is an aerosol stabilization system, initially developed for use with EUV source technology. Current EUV sources rely on droplet laser plasmas for EUV generation. These sources consist of a small (30 micron diameter) droplet which is irradiated with laser light. The laser excites the droplet into plasma which then emits 13.5 nm, the industry's chosen wavelength for EUV lithography. However, this technology is inherently unstable due to phase drift and instabilities in the droplet formation mechanisms, and thus requires some form of stabilization. An active feedback system for stabilization is preferable due to the continuous operation requirements of lithographic systems and high stability is required for this application since the focal spot diameter of the laser is about the same as the droplet size.

The ADaPTS technology of the present invention combines optical illumination and imaging, cutting-edge droplet technology, dedicated electronics, and custom software which act in harmony to provide active feedback stabilization of the droplet.

The process of tracking and controlling droplets is a difficult task. The ADaPTS systems and methods of the present invention use optical imaging of the droplets, then the images are fed to a computer which performs advanced image processing to determine the position of the droplet relative to a predefined position. If the droplet has drifted, commands are issued to precision motorized translation stages and the droplet is moved, mechanically or electrically, back into position. The process runs continuously unless an error is encountered.

FIG. 1 is an example of a system according to the present invention. In order to image the droplets, which are being produced at a rate of approximately 40 thousand per second (40 kHz) and traveling at approximately 10 meters per second, three light sources, such as laser diodes or other light sources, such as light emitting diodes, 3*a*, 3*b* and 3*c* are strobed at the same rate as the droplet production (40 kHz) from the droplet capillary 1, providing back-illumination of the droplet for imaging from three different angles. The electronics (not shown) perform synchronization of strobe illumination and droplet generation. This produces averaged stroboscopic images which are collected using standard optical imaging techniques using imaging lenses 4 and an imaging microscope objective 5 and imaged onto corresponding high-resolution cameras 9*a*, 9*b* and 9*c*. As shown, images are taken from three angles, two cameras 9*a* and 9*b* are configured orthogonal to the droplet's path and the third camera 9*c* is at an arbitrary angle. The first two cameras 9*a* and 9*b* are used for position calculation. Since they are orthogonal, the two images provide x, y, and z (Cartesian coordinates) position information directly. The third camera 9*c* is used for high-resolution imaging for diagnostic purposes.

Once the computer (not shown) receives images of the droplets, the center position of the droplet is computed. During initial alignment of the system, an optimum position is found and that position is used for comparison. If the droplet's current position deviates from the optimum position by more than a preset limit, the computer calculates a position correction and sends corresponding commands to a translation stage to move the generated target back to the optimum position. This process repeats continuously while the source is operating.

Figure 2:
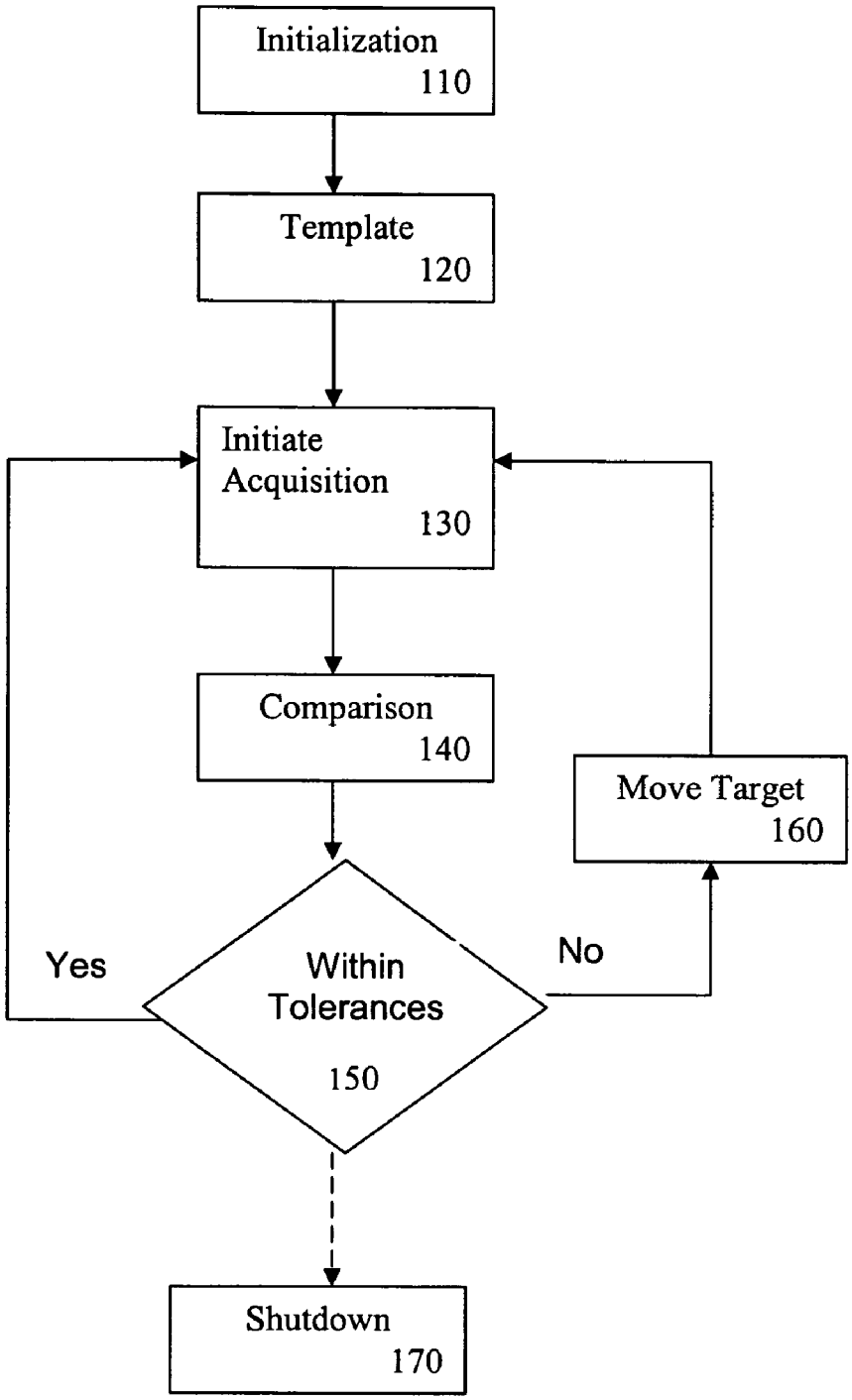
FIG. 2 is a flow diagram of the steps of the advanced droplet and plasma targeting system of the present invention.

FIG. 2 is a flow diagram of the process according to the present invention. The targeting system is based on Cartesian coordinates, with the cameras orthogonal to the three-dimensional translation stage so that the tracking and motion axes are the same. The system first initializes and configures the targeting cameras in step 110. One camera 9*a* is configured to measure the x-axis motion of the droplet, and another camera 9*b* is configured to measure the y-axis motion. Both cameras 9*a* and 9*b* monitor the z-axis motion. This enables the tracking to continue even if the image from one camera is lost or not recognized. In an embodiment, once the cameras have been configured in step 110, a live feed is displayed to an operator on a display device such as a spectrometer 10, to allow for manual alignment of the system. In the preferred embodiment however, the system is aligned electronically, under computer control.

Following optimization of the alignment, the system initiates the template algorithm in step 120. This template provides the starting position for the tracking process. As shown in FIG. 3, as part of the template process, a region of interest (ROI) is selected in step 122 for each camera. This allows the image analysis routines to ignore the portions of the image outside the general area of the droplet. This template and region of interest is stored in memory in step 124 for later comparison to the optimum position in step 140.

After the template has been created in step 120, the live video feed is restored. The live feed continues until the acquisition mode is initiated in step 130 by the system or by the user. The acquisition loop shown in FIG. 4 is the primary loop of the system. Inside this loop, each camera takes images in step 131 at a frame rate dictated by the limitations of the available data bandwidth. Each image is analyzed in step 133 to determine the actual position of the droplet in step 135. This actual position is stored in memory in step 137 and averaged in step 139 over a number of cycles, thirty cycles in this example, to reduce the effects of sudden motion, such as motion due to a gust of wind. The average position from step 139 is then compared in step 140 to the template data to see if the droplet has moved outside of the preset tolerances. If the droplet is still within the tolerances in step 150, the results of the comparison are simply displayed and logged. If the droplet has drifted outside of the preset tolerances, the system attempts to return the droplet to the template position in step 160.

Referring to FIG. 5, in step 162, the measured position is translated from pixel distances into real distances and appropriate commands are transmitted in step 164 to the translation stages to move the droplet back within tolerances. The motion is logged and displayed for later analysis of the performance of the system. In the event that the image analysis routine cannot locate the droplet for one reason or another, no further corrections are made until the droplet position is found again. User intervention may be required to restore tracking. The acquisition loop between step 130 and 160 continues until the user initiates the shutdown routine in step 170, which shuts down all appropriate devices and terminates the targeting system operation.

Operationally, the control electronics in this system perform several functions. The first is the generation of a digital timing signal, which drives the entire system. In the preferred embodiment, the signal is standard TTL level (+5V) and is adjustable in frequency, either manually or through the adaptive control software. In this example, the frequency of this signal is typically in the range of 30-40 kHz. It is also preferred that the timing signal be a square wave, wherein the "on" time is approximately the same amount of time it is "off," due to the requirements of the droplet generator. If the timing generators do not provide this preferred waveform, provision is necessary for conversion to a square wave.

Referring back to FIG. 1, once the timing signal is converted to a square wave, it is fed to the droplet generator electronics. The generator drives a piezoelectric actuator which neatly breaks the stream of water into a stream of uniform droplets. At the same time the droplets are generated, a series of laser diodes, or light emitting diodes, 3*a*, 3*b* and 3*c* are used to illuminate each droplet. Since the droplet is moving at a relatively high speed, the diode driver electronics generate a current-limited pulse of approximately one microsecond duration to freeze the motion of the droplet when it is imaged.

A separate timing signal is generated with a delay relative to the main timing signal, but at the same frequency. This timing signal is used to trigger the pump laser 14, and the delay is used to optimize the interaction of the droplet and the laser pulse. As shown, the laser beam is routed by a series of optical components such as turning mirrors 8, iris diaphragms 7, a beam steering assembly 6 and focusing optics 13. Another timing signal is generated by frequency dividing the main timing signal down to a selectable low repetition rate as a trigger signal for the imaging cameras 9*a*, 9*b* and 9*c* and optional flash illumination. The frequency division is performed automatically.

The advantages of ADaPTS technology of the present invention are not only tracking and feedback in three dimensions but also compensation for the other uncertainties of the physical parameters of the target within the system loop. The system and method also compensates both spatial displacement based on any trajectory change and temporal displacement based on droplet velocity changes.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A method for tracking and correcting positions of droplet targets and resulting plasma generated, comprising the steps of:

generating the droplet target and plasma;

activating at least two light sources to image the generated target;

strobing the at least two light sources to provide back illumination of the droplet target;

optically imaging the generated droplet target from at least three different angles to produce stroboscopic optical images;

collecting the produced stroboscopic optical images;

determining position coordinates of the generated target from the stroboscopic optical images using image processing;

comparing the determined position coordinates relative to a set of predefined position of the generated target to determine if a spatial deviation has occurred; and moving the generated target back to the set position if a spatial deviation has occurred as an advanced droplet and plasma targeting system with active feedback stabilization of the target.

2. The method of claim 1, wherein the step of moving includes the step of:

mechanically moving the generated target back to the set position if the spatial deviation has occurred.

3. The method of claim 1, wherein the step of moving includes the step of:

electronically moving the generated target back to the set position if the spatial deviation has occurred.

4. The method of claim 1, wherein the step of strobing includes the step of:

strobing the light source at approximately the same rate as the droplet production to provide the illumination of the droplet target for stroboscopic imaging.

5. The method of claim 1, wherein the position coordinates determination step comprises the steps of:

analyzing the optical image of the generated target to determine the droplet position coordinates;

storing the droplet position coordinates;

repeating the analysis and storing steps a predetermined number of times; and processing the stored droplet positions coordinates to reduce effects of sudden motion.

6. The method of claim 5, wherein the step of optically imaging includes the step of:

Imaging orthogonal images of the generated target with at least two cameras to determine Cartesian coordinates from the at least two images.

7. The method of claim 6, further comprising the step of:

imaging an arbitrary angle image of the generated target for diagnostic purposes.

8. The method of claim 6, further comprising the step of:

imaging an arbitrary angle image of the generated target for optimization purposes.

9. The method of claim 5, wherein the step of determining position coordinates includes the step of:

calculating center position of the generated target.

10. The method of claim 1, wherein targets are selected to produce a desired wavelength emission, wherein the emission can be tuned over the electromagnetic spectrum from far infrared to x-rays.

11. The method of claim 6, further comprising the steps of:

synchronizing the droplet generation and the optical imaging; and selecting a region of interest for the imaging step.

12. The method of claim 11, further comprising the steps of:

automatically determining a region of interest for the imaging step.

13. An active feedback system for monitoring generated droplet and plasma targets, comprising:

a controller having a memory for executing instructions to electrically control an operation of the system;

a light source for optically illuminating the generated target with a strobed light;

at least two cameras for imaging the illuminated target a processing unit for executing instructions;

a motorized translations system for receiving a set of commands and moving the target according to the set of commands;

a first executable set of instructions for determining coordinate position of the generated target from the images;

a second executable set of instructions for comparing the determined coordinate position to a predetermined position;

a third executable set of instructions for generating the set of commands for correcting the generated target position if it is outside the set position; and a fourth executable set of instructions executing the set of commands for automatic optimization of the output which adjusts the set position to optimum.

14. The system of claim 13, wherein the first set of instructions comprises:

a first subset of instructions for analyzing the images from the at least two cameras to determine position coordinates for a predetermined number of cycles;

a second subset of instructions for storing the position coordinates; and a third subset of instructions for processing the stored position coordinates to reduce the effects of sudden motion.

15. The system of claim 13, wherein the at least two cameras comprises:

a first camera and corresponding optics configured to measure a x-axis motion and a z-axis motion; and a second camera and corresponding optics configured to measure a y-axis motion and the z-axis motion, wherein the images from the first and second camera provide the position coordinates.

16. The system of claim 15, further comprising:

a third camera and corresponding optics configured at an arbitrary angle for high-resolution imaging for diagnostic purposes.

17. The system of claim 15, further comprising:

a third camera and corresponding optics configured at an arbitrary angle for high-resolution imaging for optimization of the plasma emission.

18. The system of claim 13, wherein the controller further comprises:

a synchronizer for generating timing signals for controlling production of generated target, for triggering the at least two cameras and strobing the light source to freeze motion of the generated target when imaged by the at least two cameras.

19. The system of claim 13, wherein the light source comprises:

at least two light emitting diodes.

20. The system of claim 13, wherein the light source comprises:

at least two laser diodes.

21. The system of claim 13, wherein the light source comprises:

at least two light sources configured at orthogonal angles to a beam of the generated droplet or plasma target and synchronized to the droplet or plasma target generation for strobe illumination for the at least two cameras to produce stroboscopic images.

22. The system of claim 21, further comprising:

a third light source configured at an arbitrary angle and synchronized with the first and second light sources.

23. The system of claim 21, further comprising:

a third light source configured at an arbitrary angle and having an adjustment between the first and second light sources.

24. A method for monitoring generated droplet and plasma targets, comprising the steps of:

tracking position of a generated droplet and plasma target;

providing feedback on the position; and controlling the position of the generated target if the generated target is outside a set coordinate location.

* * * * *